US008740755B2

(12) United States Patent
Chen et al.

(10) Patent No.: US 8,740,755 B2
(45) Date of Patent: Jun. 3, 2014

(54) ELLIPTICAL EXERCISE APPARATUS

(75) Inventors: Chun-Ho Chen, Taichung (TW); Chia-Hsun Chuang, Taichung (TW)

(73) Assignee: Cycling & Health Tech Industry R & D Center, Taichung (TW)

( * ) Notice: Subject to any disclaimer, the term of this patent is extended or adjusted under 35 U.S.C. 154(b) by 293 days.

(21) Appl. No.: 13/337,923

(22) Filed: Dec. 27, 2011

(65) Prior Publication Data

US 2012/0277064 A1 Nov. 1, 2012

(30) Foreign Application Priority Data

Apr. 26, 2011 (TW) ..... 100114424 A

(51) Int. Cl.
*A63B 22/04* (2006.01)

(52) U.S. Cl.
USPC ..... 482/52; 482/51

(58) Field of Classification Search
CPC ..... A63B 22/00; A63B 22/01; A63B 22/04; A63B 22/06; A63B 22/0605; A63B 22/0664; A63B 22/08
USPC ..... 482/51–53, 57, 62, 70, 79, 80, 121, 482/128, 908
See application file for complete search history.

(56) References Cited

U.S. PATENT DOCUMENTS

| | | | | |
|---|---|---|---|---|
| 6,761,665 | B2 * | 7/2004 | Nguyen | 482/51 |
| 7,329,207 | B1 * | 2/2008 | Maresh | 482/52 |
| 7,648,445 | B1 | 1/2010 | Chen et al. | |
| 7,682,288 | B1 * | 3/2010 | Stearns et al. | 482/51 |
| 7,833,134 | B2 * | 11/2010 | Gordon | 482/52 |
| 2006/0172862 | A1 * | 8/2006 | Badarneh et al. | 482/52 |
| 2009/0111663 | A1 * | 4/2009 | Kuo | 482/53 |

* cited by examiner

*Primary Examiner* — Loan H Thanh
*Assistant Examiner* — Nyca T Nguyen
(74) *Attorney, Agent, or Firm* — Muncy, Geissler, Olds & Lowe, P.C.

(57) ABSTRACT

An elliptical exercise apparatus includes a base frame with two supporting frames, two swing sleeves each pivotally connected with one supporting frame, two sliding arms each having a top portion slidably inserted through one swing sleeve and a bottom portion extending transversely inwardly and coupled with a treadle, two swing arms each having an end pivotally coupled with the base frame, and two sliding sleeves each axially slidably sleeved onto one swing arm and pivotally connected with the bottom portion of one sliding arm through a pivot. A rotational shaft is transversely and rotationally coupled with the base frame. Two links each have an end vertically coupled with one of two ends of the rotational shaft, and an opposite end pivotally connected with a lower portion of one of the sliding sleeves.

8 Claims, 9 Drawing Sheets

ELLIPTICAL EXERCISE APPARATUS

BACKGROUND OF THE INVENTION

1. Field of the Invention

The present invention relates to exercise apparatuses, and more particularly, to an exercise apparatus that generates an elliptical exercise track.

2. Description of the Related Art

To modern people who live a busy life with less opportunity and time to do exercise, it is important to keep healthy by taking exercise regularly. Thus, indoor exercise equipment is popular in both houses and fitness clubs for its availability and accessibility.

Since walking has been medically proven as a moderate and relaxing exercise suitable to average people, exercise equipment related thereto, such as fitness steppers and cross trainers, is taking a significant market share. However, a stepper only facilitates a simple "mark time" movement of legs. A known cross trainer trains not only lower and upper limbs, but also arms, thus being multifunctional and more interesting to exercisers.

The conventional cross trainer preliminary comprises a frame mounted thereon a pair of handle-shafts swingable backward and forward. Each said handle-shaft has an upper end provided with a handle portion and a lower end coupled with a treadle. Thereby, the alternately swing handle-shafts guide an exerciser stepping on the treadles and holding the handle portions to perform in-place striding. However, the swing handle-shafts themselves can only perform simple pendulum-like swinging and thus only a limited range of exercisers' muscles can get trained by the conventional cross trainer. For the same reason, the exercise motion guided by the conventional cross trainer is still far from genuine human striding. Besides, two treadle-shafts of the conventional cross trainer are configured to move independent of each other and are prone to get interfered by the hands' operation. During exercise, when exercising with rapidness or under uncoordinated limb movements, an exerciser may have difficulty in keeping continuity and balance and thus risks getting muscle strains or may fall down from the trainer.

U.S. Pat. No. 7,648,445 disclosed an elliptical exercise apparatus capable of simulating human striding and running and increasing muscles of exerciser's legs and feet, achieving improved exercise effect. The apparatus disclosed in the aforesaid patent can direct exerciser's legs in two counter directions, thereby preventing the exerciser's two feet from simultaneously moving forward or backward and preventing the exerciser from exercising with only one foot due to the exerciser's poor coordination. As a result, the stepping motions of exerciser's feet may be performed smoothly and continuously.

In the aforesaid patent, the elliptical exercise track is achieved by a sliding motion of a sliding treadle assembly having a treadle portion and slidably sleeved onto a lead swing arm as well as a swing motion of the lead swing arm. However, because the sliding treadle assembly occupies a certain volume with a certain weight, the exerciser must pay much effort to raise the sliding treadle assembly along the lead swing arm when the exerciser uses he/her feet to push the treadle portions of the sliding treadle assembly, resulting in that the operating motion of the apparatus becomes heavy and lumberly and the exerciser may fell slack about the operating motion while the exerciser does exercise on the apparatus. In addition, because of the sliding treadle assembly occupying a certain volume with a certain weight, the rollers installed inside the sliding treadle assembly may wear badly during reciprocally up-and-down sliding motion of the sliding treadle assembly. Therefore, a great amount of rollers need to be used inside the sliding treadle assembly for sharing heavy load so as to increase lifespan of the apparatus. In other words, the apparatus disclosed in the aforesaid patent solves the problem of the conventional cross trainer but has some drawbacks needed to be improved.

SUMMARY OF THE INVENTION

The present invention has been accomplished in view of the above-noted circumstances. It is therefore the primary objective of the present invention to provide an elliptical exercise apparatus that generates an elliptical or elliptical-like exercise track simulating human striding and/or running to train various muscles of human leg and foot, thus providing improved exercise effects, wherein the elliptical exercise apparatus guides two lower limbs of an exerciser thereon to move counter to each other so as to ensure a smooth and continuous striding exercise by preventing the exerciser's two feet from simultaneously moving forward or backward and preventing the exerciser from exercising with only one foot due to the exerciser's poor coordination.

To achieve the above-mentioned objective, an elliptical exercise apparatus provided by the present invention comprises a body having a base frame and two supporting frames uprightly disposed at two opposite sides of the base frame, a pair of swing sleeves each pivotally connected with one of the two supporting frames, a pair of sliding arms each having a top portion slidably inserted through one of the swing sleeves and a bottom portion extending transversely inwardly and coupled with a treadle, a pair of swing arms each having an end pivotally coupled with the base frame, a pair of sliding sleeves each axially slidably sleeved onto one of the swing arms and pivotally connected with the bottom portion of one of the sliding arms through a pivot, a rotational shaft transversely and rotationally coupled with the base frame, and two links, each of which has an end vertically coupled with one of two ends of the rotational shaft and an opposite end pivotally connected with a lower portion of one of the sliding sleeves.

In operation, when an exercise pushes on the treadles, the swing sleeves and the swing arms respectively swing back and forth, the sliding arms and the sliding sleeves slide up and down along the swing sleeves and the swing anus respectively, and the links synchronously rotate about the rotational shaft. By means of the swing sleeves, sliding arms, swing arms, sliding sleeves, rotational shaft and the links, the treadles move along an elliptical exercise track.

In addition, by means of using the sliding arm, which slides relative to the swing sleeve and swings back and forth along with the swing sleeve, the weights and volumes of the sliding arms and treadles are dramatically decreased. By this design, the apparatus of the present invention can not only run lightly and smoothly but also minimize the amount of rollers used inside the swing sleeve so as to increase the durable service life of the swing sleeve.

Further, a handle may be further provided at a top end of the sliding arm, such that the handle moving along with swing and sliding motions of the sliding arm enables coordination of exerciser's arm motion with exercise's leg motion. As a result, the elliptical exercise apparatus can be operated more smoothly and continuously.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
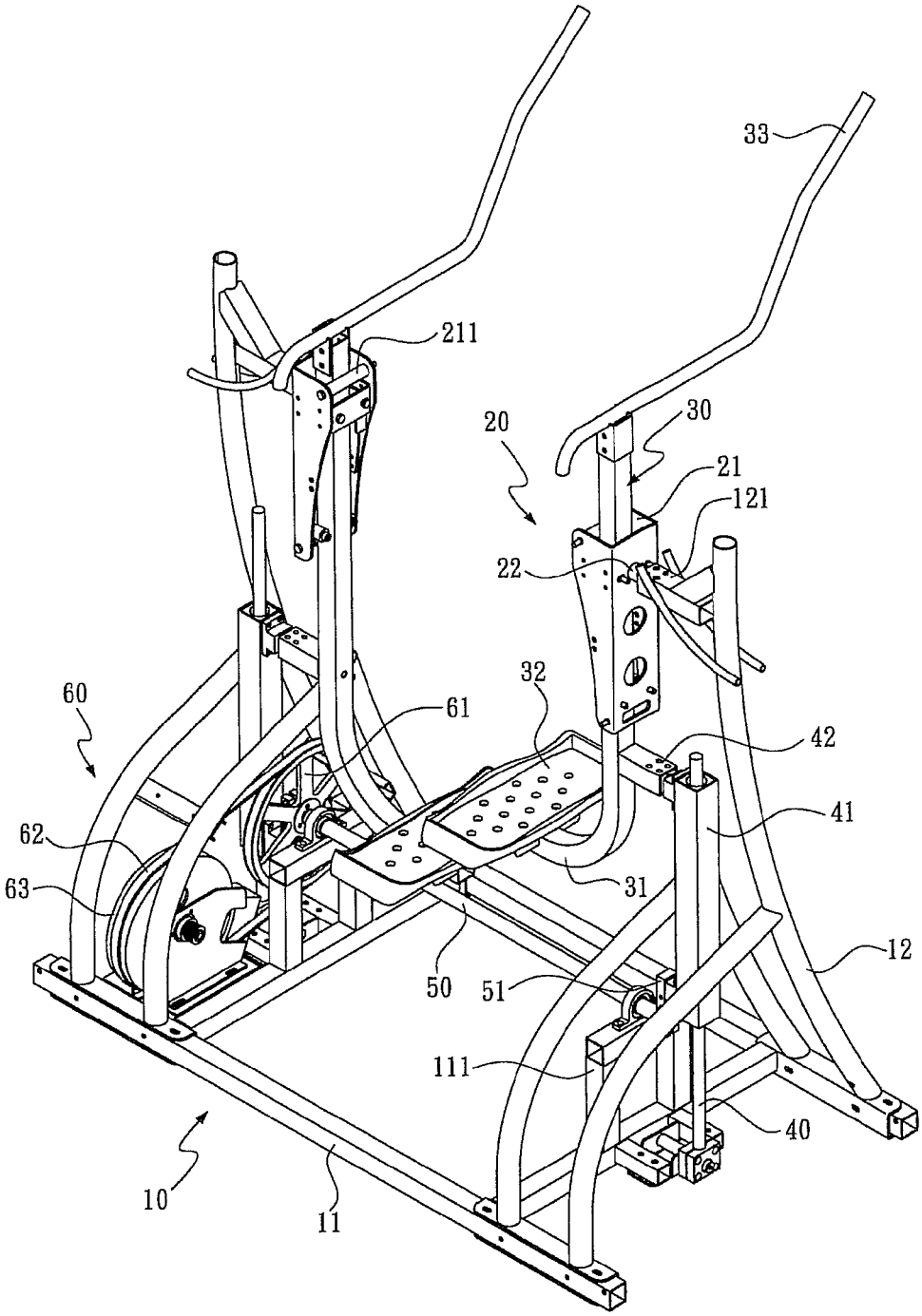
FIG. 1 is a perspective view of an elliptical exercise apparatus according to a preferred embodiment of the present invention.
Figure 2:
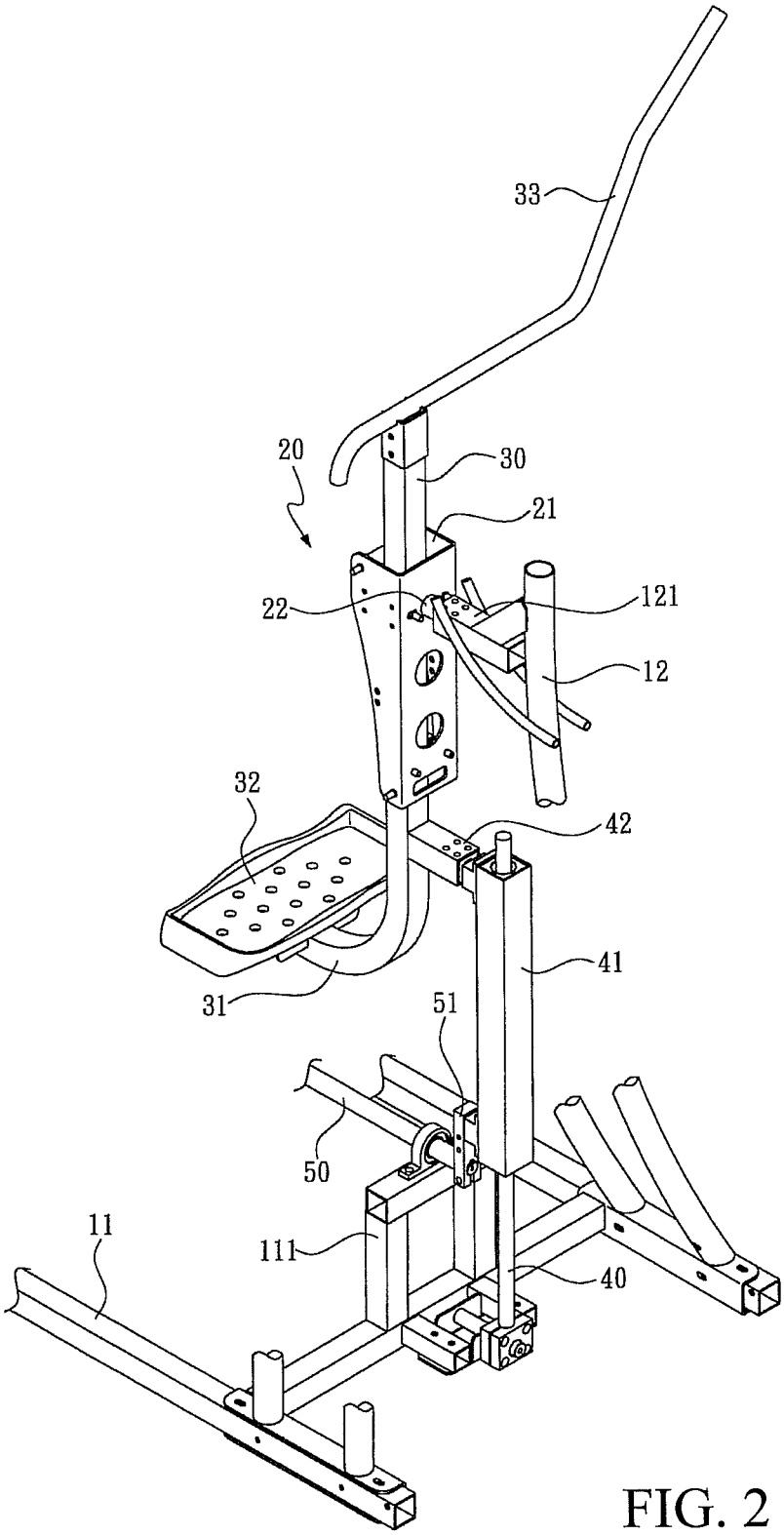
FIG. 2 is a partial perspective view of the elliptical exercise apparatus of FIG. 1.
Figure 3:
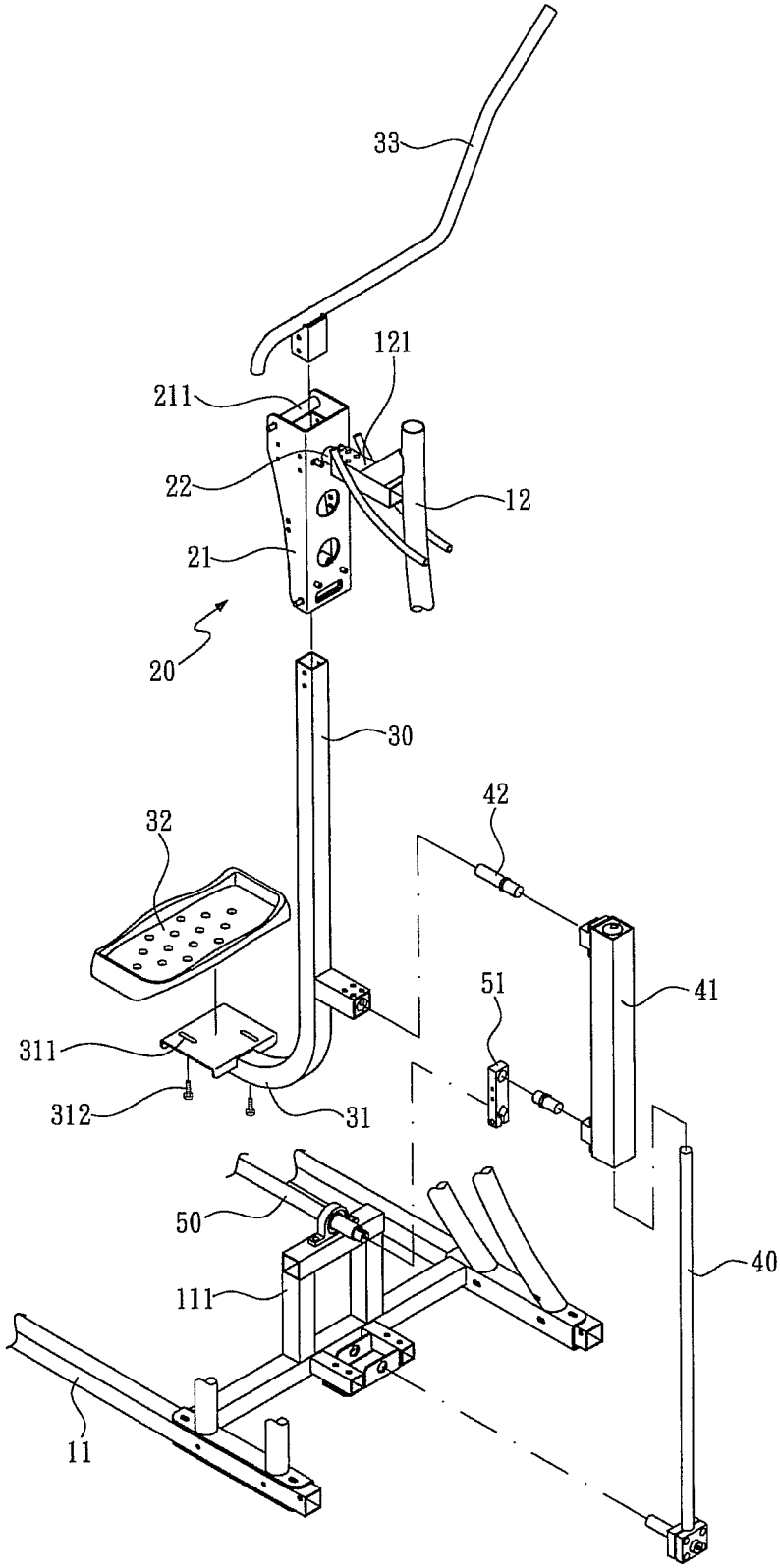
FIG. 3 is an exploded view of FIG. 2.
Figure 4:
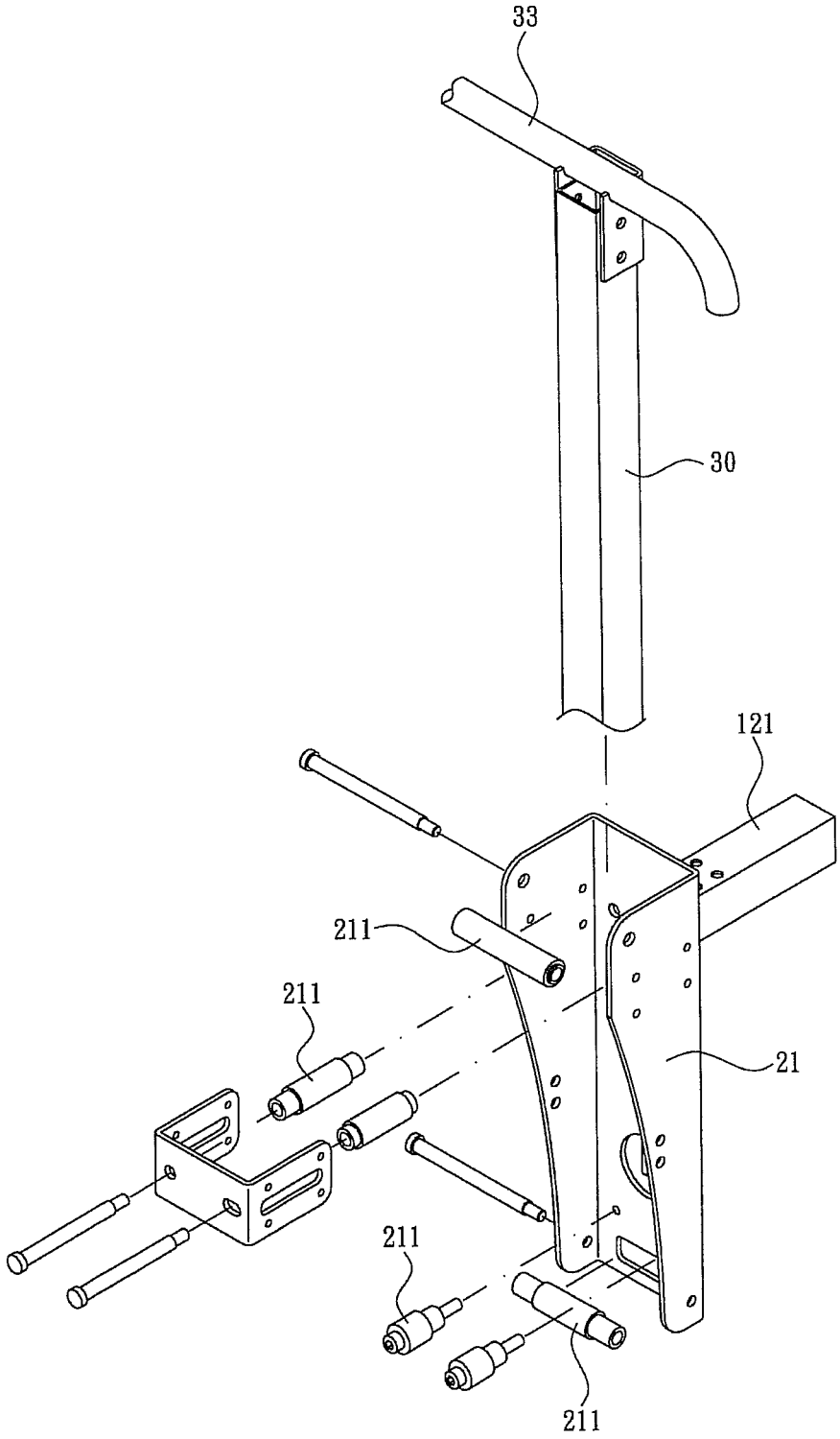
FIG. 4 is a partially exploded view of a swing sleeve of the elliptical exercise apparatus of FIG. 1.
Figure 5:
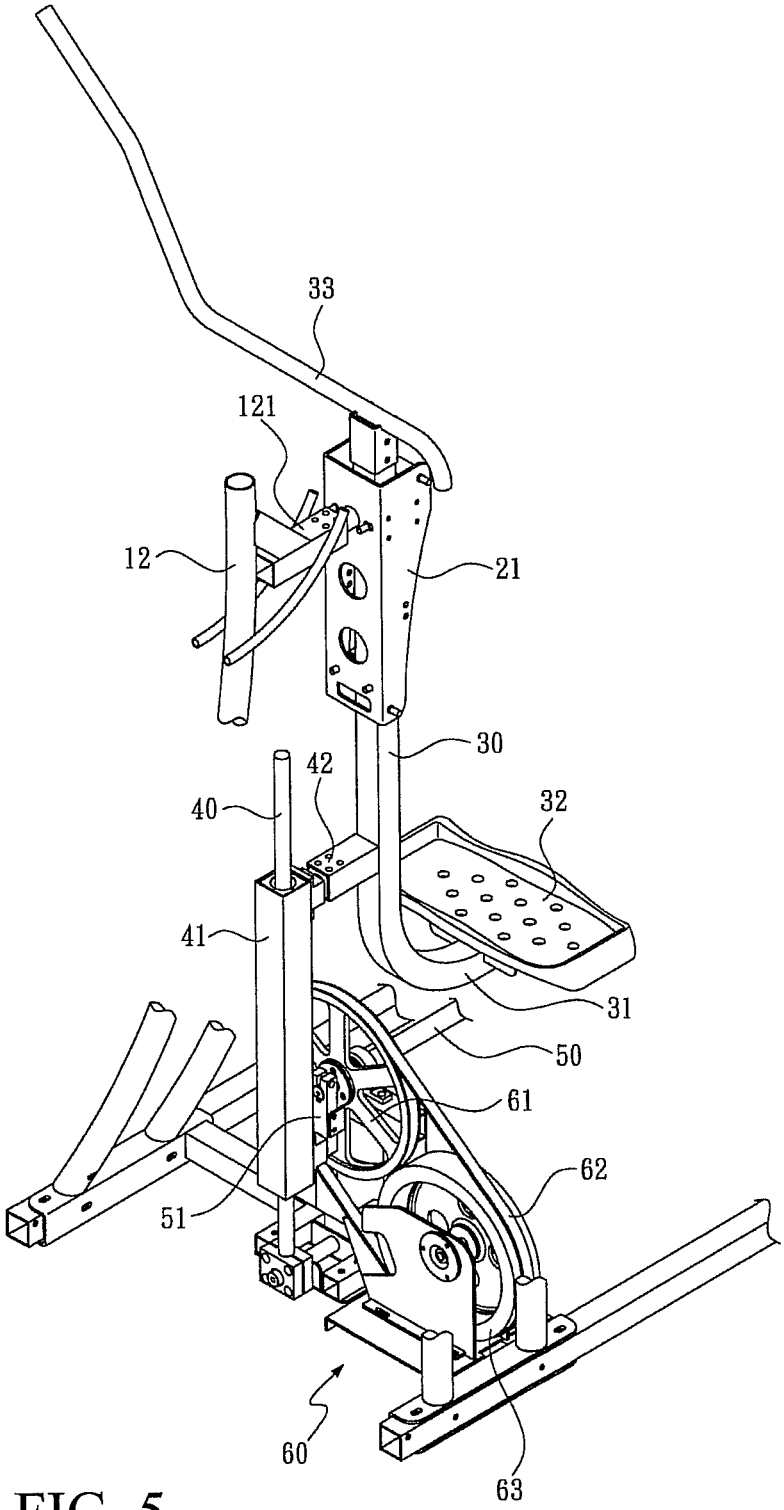
FIG. 5 is a partial perspective view of a resistance-adjusting device of the elliptical exercise apparatus of FIG. 1.

As shown in FIGS. 1-5, an elliptical exercise apparatus provided by a preferred embodiment of the present invention primarily comprises a body 10, a pair of swing sleeves 20, a pair of sliding arms 30, a pair of swing arms 40, a rotational shaft 50, and a resistance-adjusting device 60.

The body 10 has a base frame 11 and two supporting frames 12 uprightly disposed at two opposite sides of the base frame 11. Each of the supporting frames 12 has a cantilever beam 121 transversely overhanging above the base frame 11. In addition, a pair of inverted U-shaped subsidiary supporting frames 111 raised from the base frame 11 are flanked by the supporting frames 12.

Each of the swing sleeves 20 includes a hollow member 21 in which a plurality of rollers 211 are installed. On a lateral side of the hollow member 21 a pivot portion 22 pivotally connected with the corresponding cantilever beam 121 of the supporting frame 12 is provided, such that the swing sleeves 20 are pivotally connected with the supporting frames 12 respectively.

Each sliding arm 30 has a top portion slidably inserted through the hollow member 21 of one of the swing sleeves 20 and the surface of the sliding arm 30 slidably abuts against the rollers 211, such that the sliding arm 30 is slidably moveable relative to the hollow member 21 of the swing sleeve 20 with less friction. A bottom portion of each of sliding arms 30 is bent transversely inwardly to form a treadle-supporting segment 31 on which a treadle 32 is mounted. The treadle-supporting segment 31 is provided with at least one elongated slot 311 for allowing a plurality of adjusting screws 312 to pierce therethrough so as to fasten the treadle 32 to the treadle-supporting segment 31. In addition, since the elongated slot 311 extends transversely, this design allows an exerciser to adjust the relative position between the treadle-supporting segment 31 and the treadle 32 according to his/her physical conditions by changing the position of the adjusting screws 312 in the elongated slot 311. Further, a handle 33 is mounted to a top end of the sliding arm 30 for being held by the palm of the exerciser.

Each of the swing arms 40 has one end pivotally coupled with the base frame 11 between the corresponding supporting frame 12 and sliding arm 30. A sliding sleeve 41, which is realized as a hollow rod in this preferred embodiment, is slidably sleeved onto the swing arm 40, such that the sliding sleeve 41 is slidably moveable along an axial direction of the swing arm 40. In addition, the sliding sleeve 41 has an upper end pivotally coupled with the bottom portion of the sliding arm 30 through a pivot 42.

The rotational shaft 50 has two ends pivotally coupled with the subsidiary supporting frames 111 so as to be posed over the base frame 11 in a transverse and rotatable manner with respect to the base frame 11. At each of the two ends of the rotational shaft 50, a link 51 is vertically coupled. The link 51 can drive the rotational shaft 50 to rotate and has an end far from the rotational shaft 50 pivotally coupled with a lower end of the sliding sleeve 41. In virtue of the subsidiary supporting frames 111, even upon arriving at the lowest level along their rotational track, joints between the links 51 and the sliding sleeves 41 still remain higher than the joints between the swing arms 40 and the base frame 11. On the other hand, the links 51 at the opposite ends of the rotational shaft 50 are posed to extend in opposite directions.

The resistance-adjusting device 60 has a wheel 61 coupled with and rotating with the rotational shaft 50. The wheel 61 is further coupled through a belt 62 with a damper 63 capable of adjusting a rotational resistance exerting on the rotational shaft 50.

Figure 6:
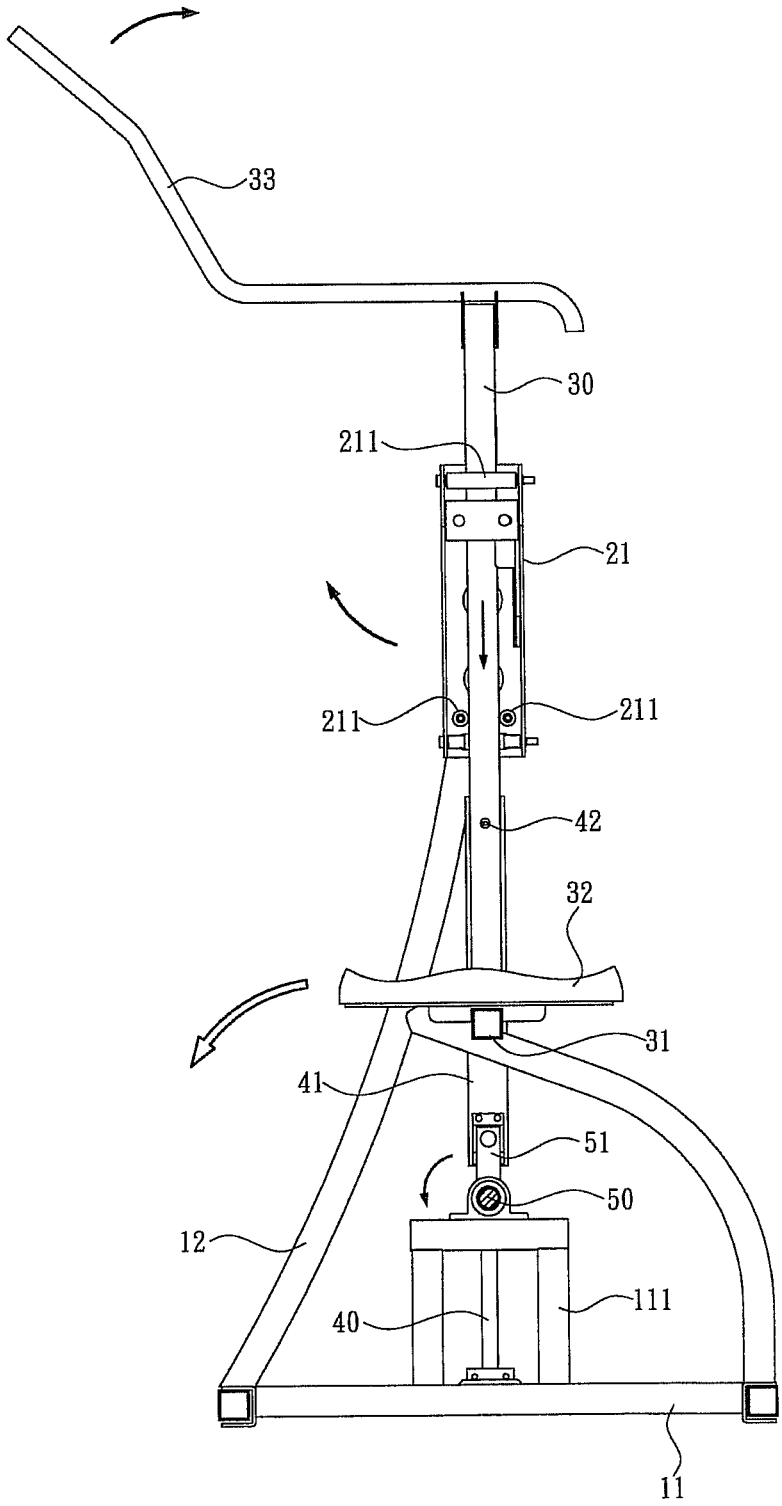
FIGS. 6-9 are schematic drawings showing operation of the elliptical exercise apparatus of the present invention.
Figure 7:
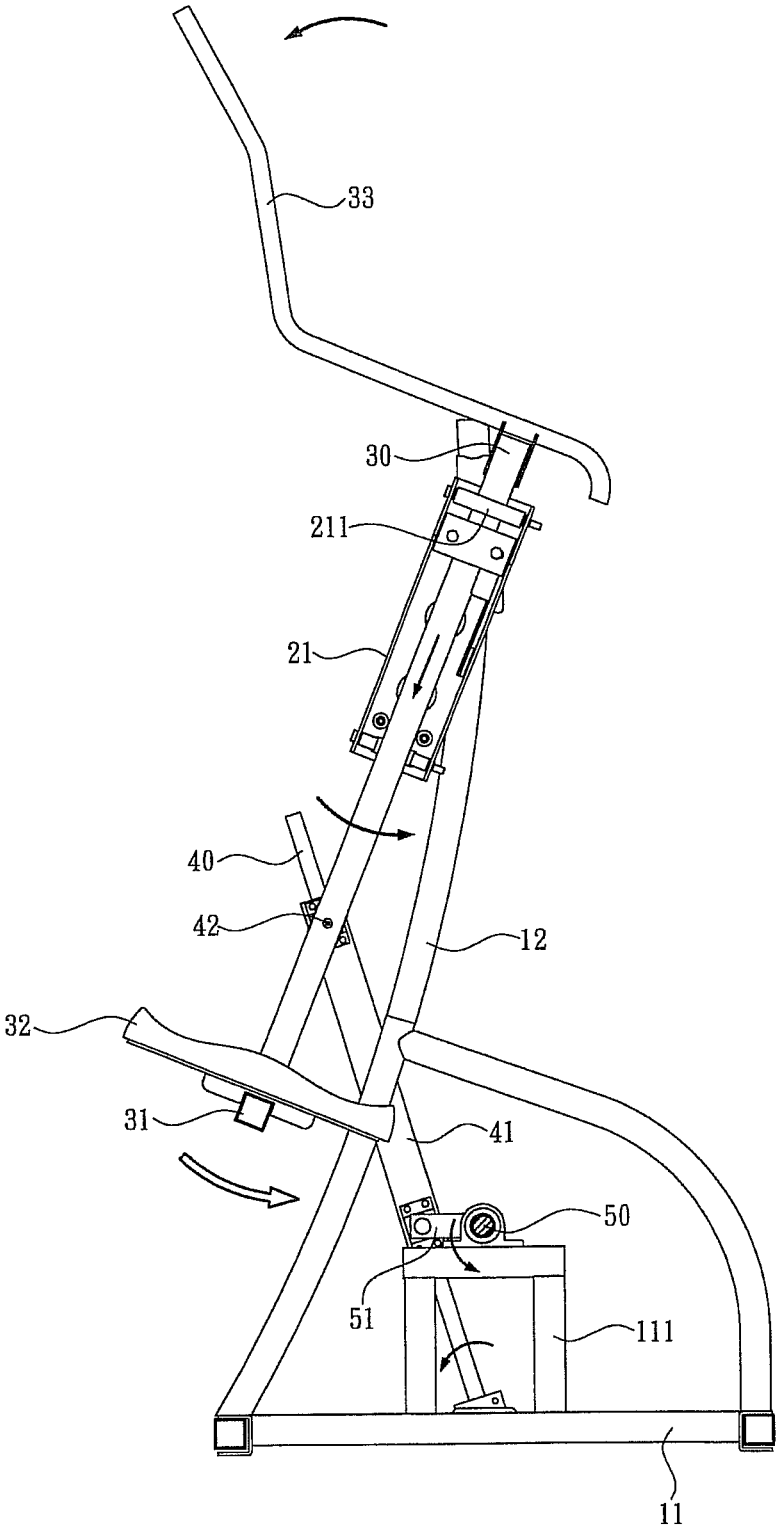

In FIGS. 6 through 9, the lateral views taken from middle toward the right side of the body 10 are provided for illustrating the operation of the elliptical exercise apparatus. As can be seen in FIG. 6, the treadle 32 is initially positioned at a highest point. When an exerciser's right foot pushes the treadle 32 forward and downward and the handle 33 is pulled backward, the swing sleeve 20 correspondingly swings forward due to the pushing effect of the exerciser's right foot and the pulling effect of the exerciser's hand exerting on the sliding arm 30, and the sliding arm 30 slides axially and downwardly along the swing sleeve 20. Consequently, the swing arm 40 swings forward due to the linkage between the sliding sleeve 41 and the sliding arm 30. Meantime, the sliding sleeve 41 pivotally connected with the link 51 slides axially along the swing arm 40 to move toward the lower end of the swing arm 40. As a result, the link 51 is driven to rotate in the counterclockwise direction, as shown in FIG. 7, which in turn drives the rotational shaft 50 to rotate synchronously. Thereby, the exerciser's right foot is led to take a forward stride.

Referring to FIG. 7, after the treadle 32 arrives at the headmost position of its swing motion, the exerciser's right foot pushes the treadle 32 backward and downward, and the exerciser's right hand pushes the handle portion 21 forward. In response to the operation, the swing sleeve 20, the sliding arms 30 and the swing arm 40 swing backward and the link 50 rotates toward a lower rear direction thereof, such that the sliding arm 30 slides axially downwardly in the swing sleeve 20 and the sliding sleeve 41 slides toward the lower end of the swing arm 40, leading the treadle 32 to swing backward and downward.

Figure 8:
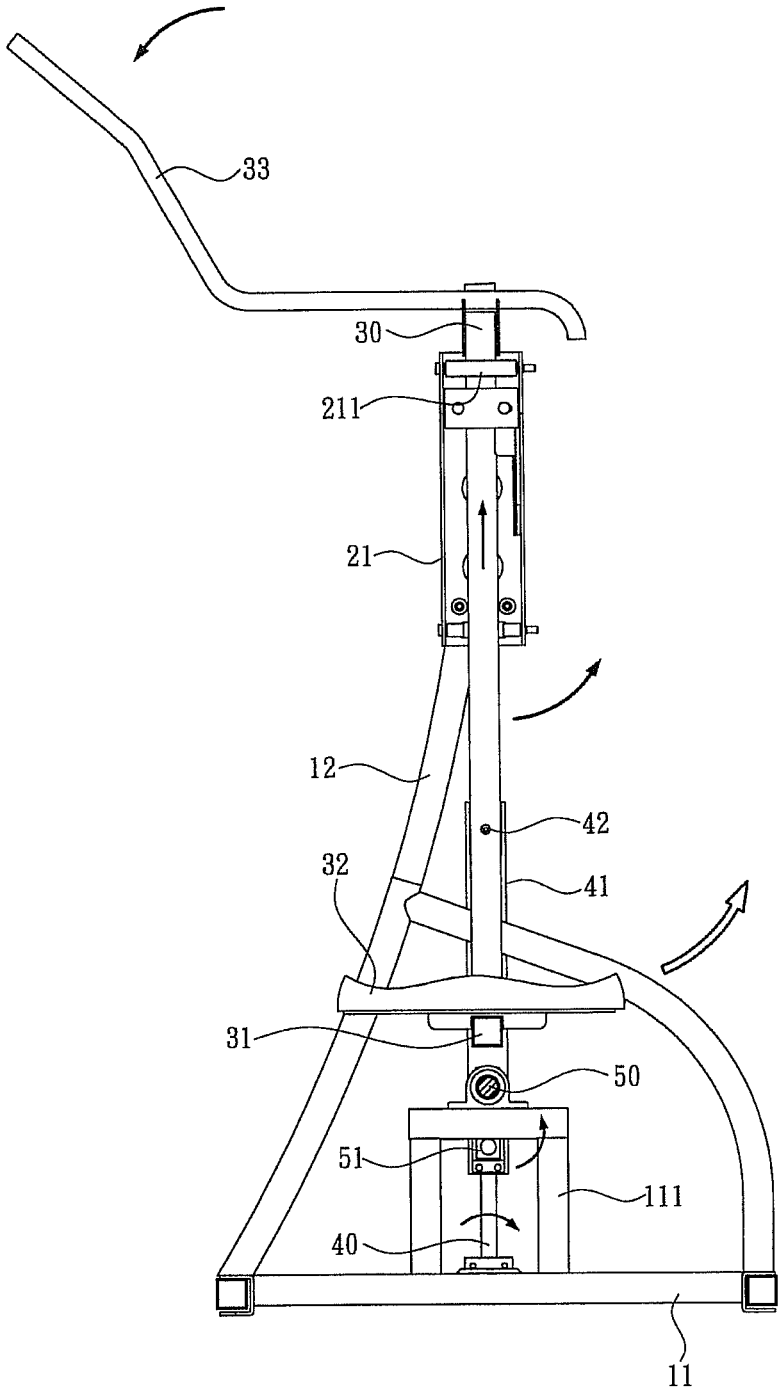

Referring to FIG. 8, after the treadle 32 passes through the lowest position of its swing motion, the exerciser's right hand continuously pushes the handle 33 forward and the swing sleeve 20, the sliding arms 30 and the swing arm 40 continuously swing backward and the link 41 rotates toward an upper rear direction thereof. As a result, the sliding arm 30 slides axially upwardly along the swing sleeve 20 and the sliding sleeve 41 slides toward the upper end of the swing arm 40, leading the treadle 32 to swing backward and upward. Consequently, the exerciser's foot on the treadle 32 performs a backward and upward swing.

Figure 9:
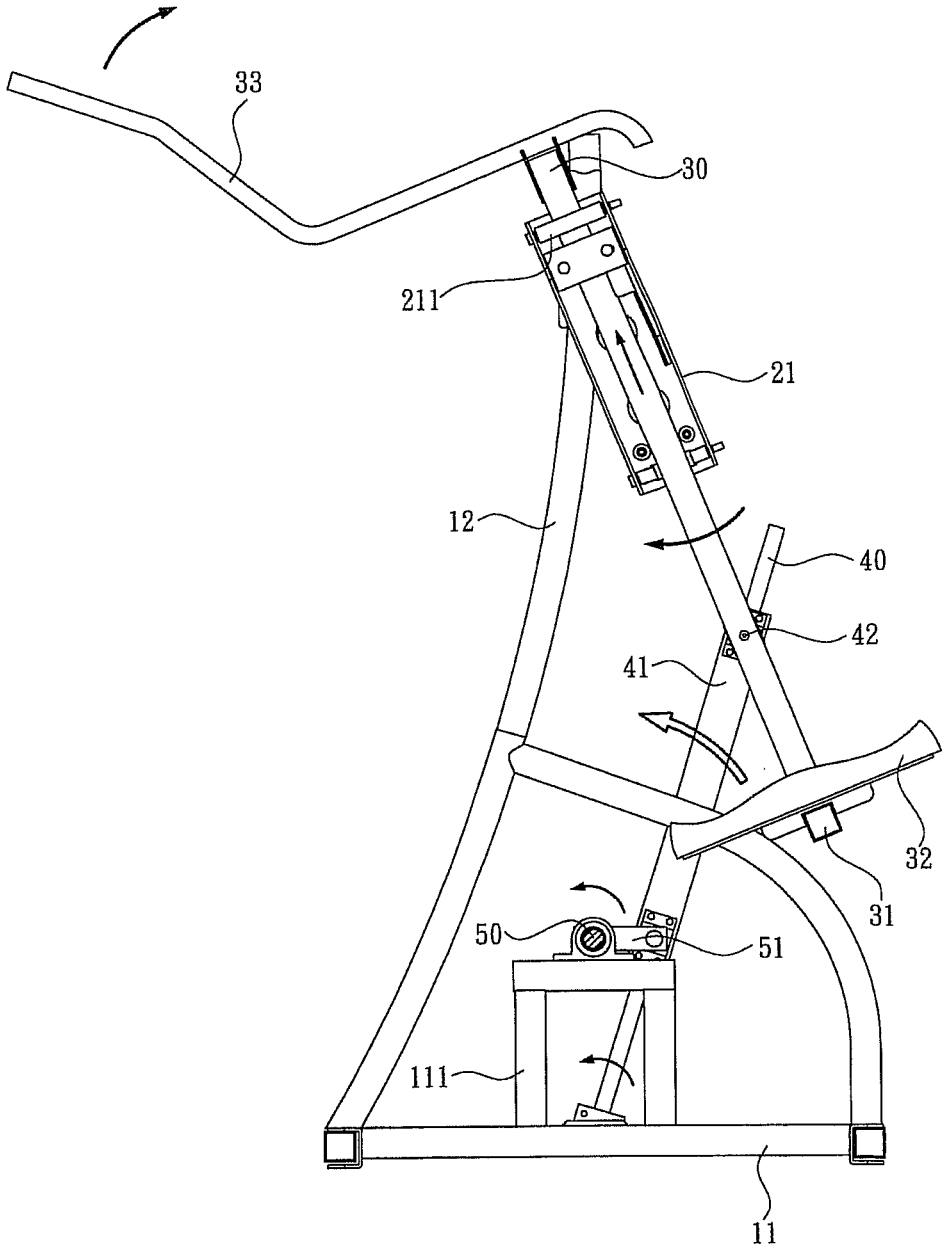

Referring to FIG. 9, when the treadle 32 passes through the endmost position of its swing motion, the handle 33 swings backward, the swing sleeve 20, the sliding arms 30 and the swing arm 40 swing forward again, and the link 41 rotates toward an upper front direction thereof. As a result, the sliding arm 30 slides axially upwardly along the swing sleeve 20 and the sliding sleeve 41 slides toward the upper end of the swing arm 40, leading the treadle 32 to swing forward and upward and then return to the initial position as shown in FIG. 6. Consequently, the exerciser's foot on the treadle 32 performs a forward stride.

By means of the cooperation among the swing sleeve 20, the sliding arm 30, the swing arm 40, the sliding sleeve 41, the rotational shaft 50 and the link 51, the treadle 32 travels along an elliptical or elliptical-like exercise track. Thereby, the elliptical exercise apparatus of the present invention can accurately simulate human striding and/or running and can provide improved exercise effects to the user by facilitating training muscles of his/her leg.

Besides, since the links 51 at the opposite ends of the rotational shaft 50 are posed to extend in opposite directions, it is ensured that the exerciser's two feet are led to move in opposite directions at the same time so as to prevent the exerciser's two feet from simultaneously moving forward or backward and prevent the exerciser from exercising with only one foot due to the exerciser's poor coordination. Moreover, the rotational shaft 50 transmits the stepping force exerting on one treadle to the other. Thus, when one of the exerciser's feet steps downward on one treadle 32, the rotational shaft 50 transmits and coverts the downward force to the other treadle 32 on which the exerciser's the other foot steps as an upward force, so as to facilitate a smooth and continuous striding exercise.

Also, when the rotational shaft 50 rotates, the wheel 61 that is coupled with the damper 63 via the belt 62 is driven to rotate. The increase of resistance at the damper 63 gives an increased resistance to the rotational shaft 50, requiring the exerciser to push the treadle 32 with more strength. Thus, by adjusting the resistance provided by the damper 63, the elliptical exercise apparatus can be adjusted to present a variable exercise level to the exerciser.

Further, the handle 33 is moved in response to the swinging and sliding motions of the sliding arm 30. This design enables the exerciser's arms to move coordinately with exercise's legs. Therefore, the elliptical exercise apparatus of the present invention can be operated more smoothly and continuously.

The present invention has been described with reference to the preferred embodiment and it is understood that the embodiment is not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An elliptical exercise apparatus, comprising:

a body having a base frame and two supporting frames at two opposite sides of the base frame;

a pair of swing sleeves each pivotally connected with one of the two supporting frames;

a pair of sliding arms each having a top portion slidably inserted through one of the swing sleeves, and a bottom portion extending transversely and coupled with a treadle;

a pair of swing arms each having an end pivotally coupled with the base frame;

a pair of sliding sleeves each axially slidably sleeved onto one of the swing arms and pivotally connected with the bottom portion of one of the sliding arms through a pivot;

a rotational shaft having two ends is transversely and rotationally coupled with the base frame; and two links each having an end vertically coupled with one of the two ends of the rotational shaft, and an opposite end pivotally connected with a lower portion of one of the sliding sleeves;

whereby when the treadles are pushed, the swing sleeves and the swing arms respectively swing back and forth, the sliding arms and the sliding sleeves slide vertically along the swing sleeves and the swing arms respectively, and the links synchronously rotate about the rotational shaft, causing the treadles to move along an elliptical exercise track.

2. The elliptical exercise apparatus of claim 1, wherein the sliding sleeves each comprise a hollow member installed with a plurality of rollers, said plurality of rollers abuts against a surface of one of the sliding arms.

3. The elliptical exercise apparatus of claim 2, wherein the hollow member of the sliding sleeve is provided at a lateral side thereof with a pivot portion for being pivotally connected with the supporting frame.

4. The elliptical exercise apparatus of claim 1, wherein the rotational shaft is rotationally supported by a pair of subsidiary supporting frame raised from the base frame.

5. The elliptical exercise apparatus of claim 4, wherein the links coupled with the two ends of the rotational shaft extend in opposite directions.

6. The elliptical exercise apparatus of claim 1, wherein the sliding arms each have a top end coupled with a handle.

7. The elliptical exercise apparatus of claim 1, wherein the sliding sleeve is a hollow rod slidably sleeved onto the swing arm.

8. The elliptical exercise apparatus of claim 1, further comprising a resistance-adjusting device having a wheel coupled with the rotational shaft such that the wheel is rotatable with the rotational shaft, and a damper coupled with the wheel through a belt for adjusting a rotational resistance exerting on the rotational shaft.

* * * * *